United States Patent [19]

Fike

[11] 4,126,119

[45] Nov. 21, 1978

[54] HEATING DEVICE

[76] Inventor: Claud D. Fike, 201 S. 7th St. East, Riverton, Wyo. 82501

[21] Appl. No.: 799,395

[22] Filed: May 23, 1977

[51] Int. Cl.[2] ..... F24B 7/00

[52] U.S. Cl. ..... 126/124; 126/10; 126/107; 110/101 R; 214/18 R

[58] Field of Search ..... 126/10, 120, 121, 107, 126/124; 110/101 R; 214/18 R

[56] References Cited

U.S. PATENT DOCUMENTS

| | | | |
|---|---|---|---|
| 2,277,381 | 3/1942 | Black | 126/121 |
| 2,454,400 | 11/1948 | Norman | 122/30 |
| 3,888,231 | 6/1975 | Galluzzo et al. | 126/121 |

FOREIGN PATENT DOCUMENTS

| | | | |
|---|---|---|---|
| 1,287,780 | 1/1969 | Fed. Rep. of Germany | 126/121 |

*Primary Examiner*—Ronald C. Capossela
*Attorney, Agent, or Firm*—Polster, Polster and Lucchesi

[57] ABSTRACT

A heating device such as a fireplace has a fire box with an opening in one side and an arrangement for feeding long logs, at least two at a time parallel with one another, through the opening. The device includes an enclosure for the logs and may include a jacket around at least part of the fire box through which the enclosure extends.

8 Claims, 5 Drawing Figures

HEATING DEVICE

BACKGROUND OF THE INVENTION

In many parts of the country and world, wood is plentiful and oil, gas and electricity are either unavailable or expensive. In forest areas, logs are readily available which are long and straight. Sawing them into short lengths, stacking them, and carrying the cut lengths individually to a fireplace or stove is inconvenient and frequently arduous.

In other areas, coal, lignite or the like is also available.

One of the objects of this invention is to provide a heating device whereby relatively long logs, on the order of 5 to 20 feet long, can be fed into a fire box and burned therein progressively, in such a way as to be safe, convenient, and also attractive in appearance.

Another object is to provide such a device which is capable of handling coal, lignite or the like, either in lieu of or in addition to logs.

Still another object is to provide such a device which is sufficiently efficient to provide ample heat for living quarters.

Other objects will become apparent to those skilled in the art in the light of the following description and accompanying drawing.

SUMMARY OF THE INVENTION

In accordance with this invention, generally stated, a heating device is provided which has a fire box having an opening in one side through which logs are delivered. The logs are intended to be long, and are fed individually, closely adjacent one another and parallel to one another. An enclosure is provided, with a door or other suitable closure at one end and communicating at its other end with the fire box through the opening in the side thereof. Rollers in the enclosure, which may engage the logs directly or through a belt or the like, carry the logs. Drive rollers, driven and controlled independently, convey the separate logs through the enclosure and into the fire box. The enclosure is preferably divided lengthwise by one or more partitions to define separate tunnels for each log. Water spray heads can also be provided near the fire box end of the enclosure to permit any back flame to be doused.

A second enclosure, housing a roller-driven belt, can be provided, extending from an opposite side of the combustion chamber and designed to deliver coal or the like to the fire box, preferably to a sloping grate. The belt arrangement can be such as to permit its use for either coal or logs, with simple modification.

In the preferred embodiment, the fire box communicates directly with a metal flue and an outer shell is provided, spaced from the walls defining the fire box to define with those walls and with vertical and horizontal baffles two air supply plenums each communicating with an air inlet, two hot air transfer plenums and two hot air discharge plenums, the transfer and discharge plenums being connected by crossover heat exchange pipes, and means are provided for delivering heated air from the discharge plenums to a space to be heated. The enclosure or enclosures extend through the outer shell.

DESCRIPTION OF THE PREFERRED EMBODIMENT

Figure 1:
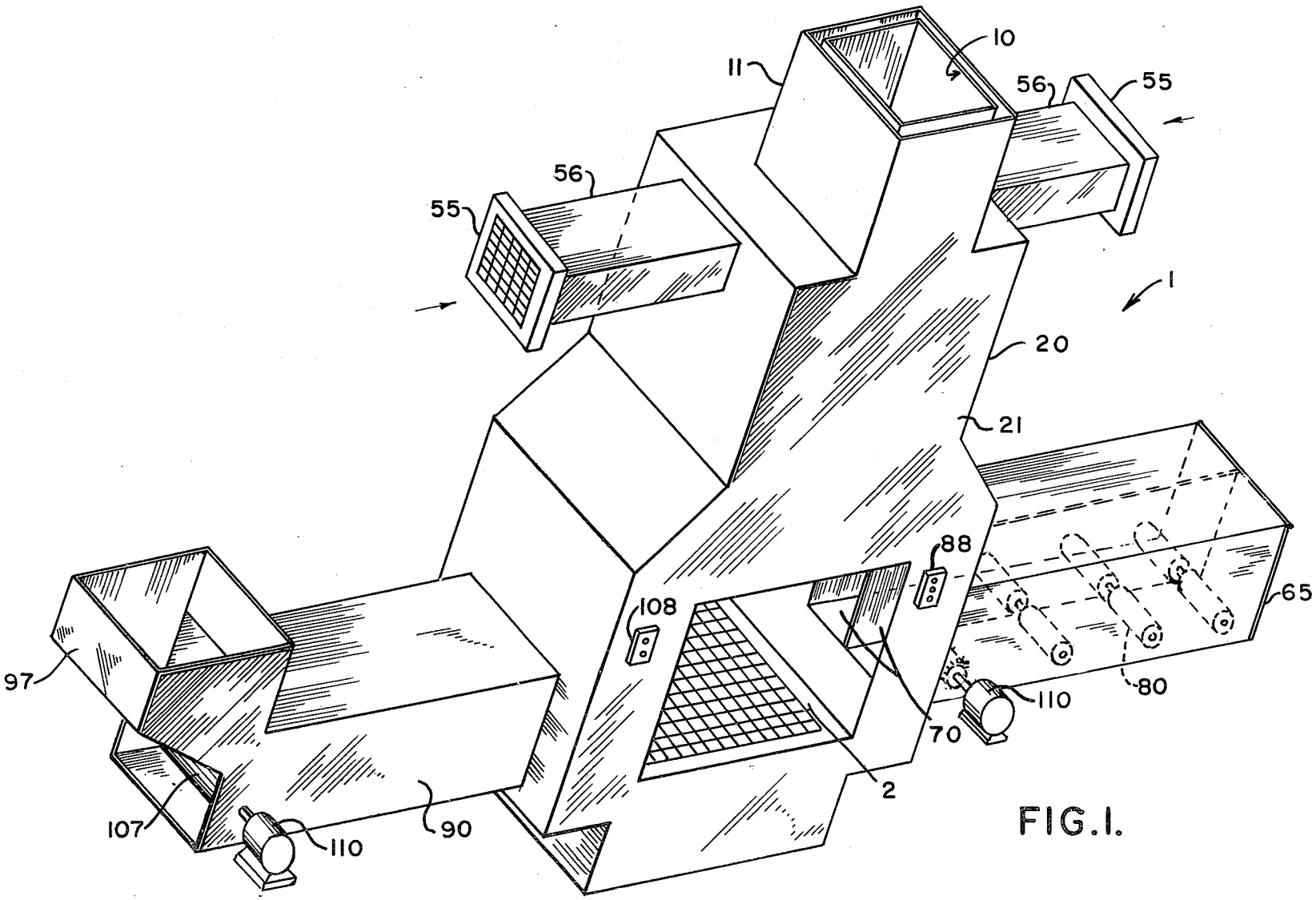
FIG. 1 is a view in perspective of one embodiment of fireplace system of this invention.
Figure 2:
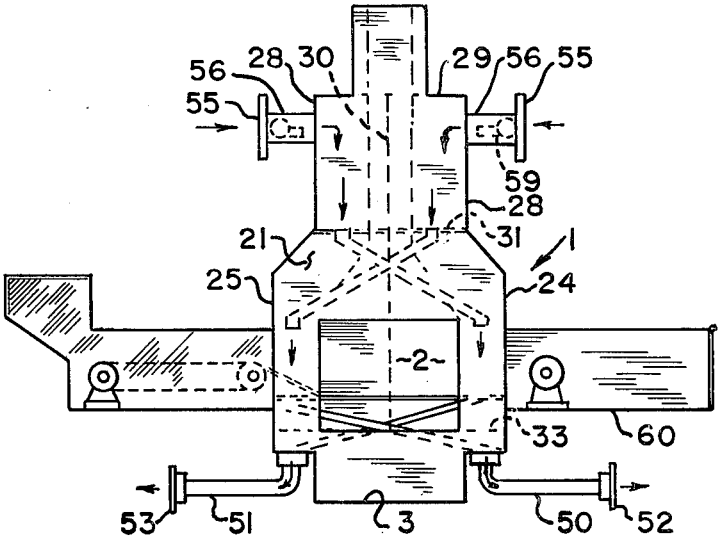
FIG. 2 is a view in side elevation of the fireplace system shown in FIG. 1.

Referring now to the drawing for one illustrative embodiment of fireplace system of this invention, reference numeral 1 indicates the complete system, which includes a combustion chamber or firebox 2, a bottom wall 3, side walls 4 and 5, a back wall 6, a flue 10 and convergently upwardly extending upper walls 7 connecting the side walls 4 and 5 with the base of the flue 10.

A flue jacket 11 is spaced from and extends around the flue 10.

The side wall 4 has a side wall opening 14 in it, and the side wall 5 has a side wall opening 15 in it.

A combustion chamber jacket 20 has a front wall 21, a bottom wall 23, lower side walls 24 and 25, a back wall 26, upper side walls 28 and upwardly convergently sloping intermediate walls 27 connecting the lower side walls 24 and 25 with the upper side walls 28.

The lower side walls 24 and 25 are spaced laterally from the side walls 4 and 5, as are the intermediate walls 27 from the walls 7. The upper side walls of the jacket are spaced from the side walls of the flue jacket 11. The back wall 26 of the combustion chamber jacket is spaced from the back wall 6 of the firebox, and also from a back wall of the flue jacket 11. The front wall 21 of the jacket 20 is fastened to and makes an airtight seal with the front edges of the side walls 4 and 5 and 14 and 15, the sloping walls 7 and 27, the upper walls 28 and front of the flue jacket 11, and with bottom flue jacket wall 23 and top flue jacket wall 29 and back wall 26 to form a plenum 8.

Figure 3:
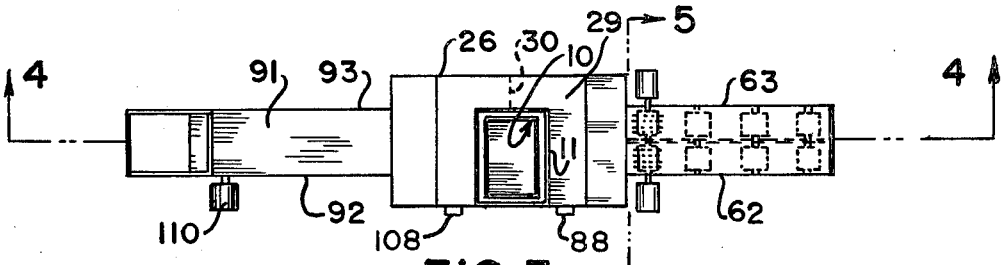
FIG. 3 is a top plan view of the system shown in FIGS. 1 and 2.
Figure 4:
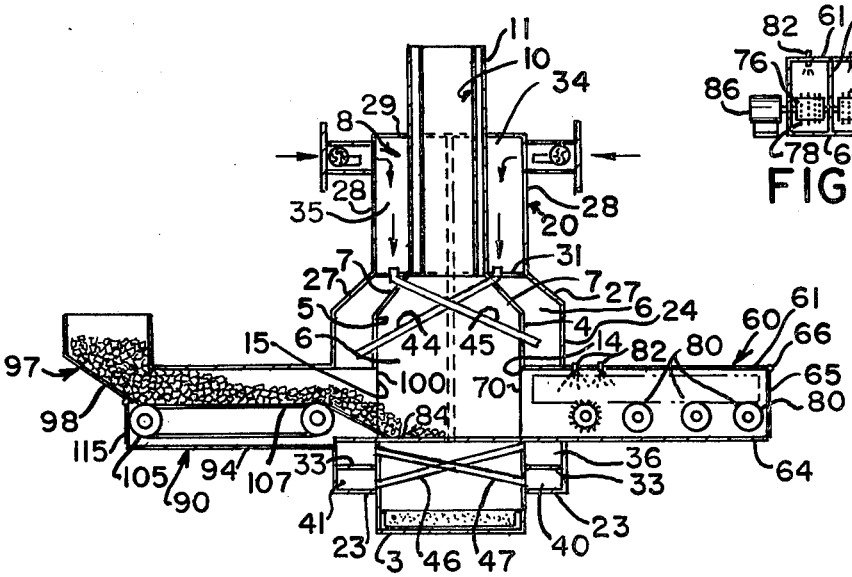
FIG. 4 is a sectional view taken along the line 4—4 of FIG. 3.
Figure 5:
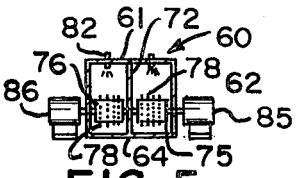
FIG. 5 is a sectional view taken along the line 5—5 of FIG. 3.

The plenum 8 is divided vertically by a vertical baffle 30 extending between the top wall 29, behind the flue jacket 11, and an extension of the bottom wall 3 behind the back wall 6 of the firebox. The plenum 8 is divided horizontally by an upper horizontal baffle 31, and a horizontal lower baffle 33. The horizontal baffles 31 and 33, like the top wall 29, are U-shaped, extending along the two side walls of the flue jacket and firebox and across the back wall, as shown particularly in FIGS. 1 and 3.

The divisions of the plenum 8 by the horizontal and vertical baffles produce right and left intake plenums 34 and 35 respectively, right and left hot air transfer plenums 36 and 37 respectively, and right and left hot air discharge plenums 40 and 41 respectively.

The intake plenum 34 is connected to the hot air transfer plenum 37 by means of an upper crossover heat exchange tube 44 opening at its upper end into the intake plenum 34 and at its lower end into the hot air transfer plenum 37. The intake plenum 35 is connected to the hot air transfer plenum 36 by an upper crossover heat exchange tube 45. The hot air transfer plenum 36 is connected to the hot air discharge plenum 41 by means of a lower crossover heat exchange tube 46, and the hot air transfer plenum 37 is connected to the hot air discharge plenum 40 by means of a lower crossover heat exchange tube 47.

Hot air duct 50 communicates at one end with the hot air discharge plenum 40, and at its other, with a register 52. The hot air duct 51 communicates at one end with the hot air discharge plenum 41, and at its other end with a register 53.

In the illustrative embodiment shown, two cold air registers 55 are provided, which communicate by means of cold air ducts 56 with the intake plenums 34 and 35. The cold air registers 55 are preferably positioned in the attic or in the clear space above the ceiling of a dwelling to be heated, and may be equipped with suitable screens and filters. Between the registers 55 and the intake plenums 34 and 35, there are electric motor-driven blowers 59, so positioned in ducts 55 as to pull air from the attic and force it into the intake plenums 34 and 35.

If desired, a single cold air register and duct can be provided with a single blower, and branch ducts can be used to divide the airflow to the two intake plenums, or part of the baffle 30 between the upper horizontal baffle 31 and the tube flue jacket wall 29 can be removed.

In the embodiment shown, a log tunnel or enclosure 60, with a top wall 61, side walls 62 and 63, and bottom wall 64 extends at one end through the side wall 24 of the combustion chamber jacket 20, and has a mouth 70 framed by the edges defining the side wall opening 14 in the firebox 2. The log enclosure 60 is airtightly connected to both the firebox 2 and the jacket 20, so that products of combustion from the firebox can not enter the transfer plenum 36 nor can air flowing through the transfer plenum 36 escape around the log enclosure.

The outer end of the log enclosure has a door 65, which can be connected to the top wall 61, as by a piano hinge 66.

A central vertical partition 72 extends the length of the log enclosure 60, between the top wall 61 and bottom wall 64.

Log drive rollers 75 and 76 are journaled for independent rotation in suitable bearings in the side walls 62 and 63 and partition 72, and are connected to drive motors 85 and 86 respectively. The drive rollers 75 and 76 are equipped with teeth 78. Idler rolls 80 are spaced lengthwise along the enclosure 60, between the drive rollers 75 and 76 and the door 65. Although three idler rolls are shown on each side of the partition, it will be appreciated that the number used will depend upon the length of the enclosure and the length of the logs proposed to be used.

In the embodiment shown, a control 88, shown as being mounted on the front wall 21, is arranged to permit the motors 85 and 86 to be operated independently of one another.

In this embodiment, spray nozzles 82 are provided in each side of the log enclosure, near the mouth 70, so that any flame or ember which reaches the inside of the enclosure can be quenched. The nozzles are connected to a suitable source of water not here shown.

A grate or grizzly 84 extends across the firebox, above the tubes 46 and 47. In this embodiment, the front wall 21, between the discharge plenums 40 and 41 forms an open-topped bin, in which the ashes drop. Preferably the back wall has a cleanout door in it, which opens outside the house.

In this illustrative embodiment, a coal supply enclosure 60 opens at a mouth 100 framed by the edges of the side wall 5 defining the opening 15. The coal supply enclosure has a top wall 91, side walls 92 and 93, and a bottom wall 94. A coal feed hopper 97 has a slanting bottom wall 98, to deliver coal to the upper surface of a chain belt 107. The belt 107 is driven by a drive roller 105, in turn driven by a motor 110, and supported at its other end by an idler roll 106. The stoker motor 105 is connected to and controlled by a control 108 mounted on the front wall 21 on the side adjacent the coal supply enclosure. A door 115 closes the outer end of the enclosure 90 below the hopper 97. A cover, not here shown, can be provided to close the open upper mouth of the hopper.

The heating device illustrated is equipped to utilize both logs and coal. It is to be understood that one or the other of the log and coal feeding systems can be omitted.

In the coal system, the hopper is preferably outside the living quarters, as is the outer end of the log enclosure.

The log delivery system is particularly useful in many parts of the western section of the United States, where thousands of long, straight dead trees, victims of bark beetles or fire, are available. These trees can be cut into suitable lengths, such as fifteen or twenty feet, and two of them can be rolled into the enclosure to the place at which the drive rollers engage them, and can then be inched into the firebox by using the control provided for that purpose. Two such logs, close together, will burn well. The heat from the logs will be utilized with particular efficiency in the system shown and described, in which a countercurrent heat exchange is provided. The system has the advantage of providing circulation of air in the attic or clear space, as well as bringing the hot air to the lower reaches of the room to be heated.

Numerous variations in the construction of the heating device of this invention within the scope of the appended claims will occur to those skilled in the art in the light of the foregoing disclosure.

Having thus described the invention, what is claimed and desired to be secured by Letters Patent is:

1. A heating device comprising a combustion chamber having an opening in one side thereof; an elongated enclosure communicating at one end with said opening and a plurality of feed means each comprising feed rollers with axes extending transversely of said enclosure, spaced lengthwise of said enclosure from one another, at least two sets of said rollers arranged transversely of the enclosure being provided to operate independently of one another whereby logs supported by said rollers can be moved, parallel to and independently of one another, into said combustion chamber by said rollers.

2. The device of claim 1 wherein said combustion chamber is open at its front to function as a fireplace.

3. The device of claim 1 wherein a vertical partition is provided between sets of rollers, whereby, within the enclosure, logs moved by said rollers are separated from one another by said partition.

4. The device of claim 1 wherein at least one of said rollers of each set is power driven, and means are provided for driving said rollers individually selectively.

5. The device of claim 1 including a second elongated enclosure opening through an opposite side of said combustion chamber from said first enclosure, a conveyor within said second enclosure arranged to discharge coal into said combustion chamber and having a feed roller for driving said conveyor and means for driving said feed roller, and a coal receiving hopper at an end of said enclosure remote from said combustion chamber, said hopper having an opening above said conveyor and being arranged to deliver coal placed in said hopper to said conveyor.

6. The device of claim 1 including spray head means positioned within the said enclosure adjacent the said combustion chamber and means for selectively supplying water to said spray head means.

7. The device of claim 1 wherein the said rollers support and drive a conveyor.

8. The device of claim 1 wherein said combustion chamber communicates with a metal flue and said flue and said combustion chamber are jacketed, with an outer shell spaced from said flue and said combustion chamber, said outer shell being divided vertically into two air supply compartments, each communicating with an air inlet, and divided horizontally, adjacent the combustion chambers, to form plenum chambers, cross heat exchange conduits extending across the said combustion chamber from the air supply compartment on one side to the plenum chamber on the other side and from the air supply compartment on said other side to the plenum chamber on the said one side, and means communicating with said plenum chamber for delivering heated air to a living space to be heated.

* * * * *